US010337162B2

(12) United States Patent
Ruel

(10) Patent No.: US 10,337,162 B2
(45) **Date of Patent: *Jul. 2, 2019**

(54) ANCHORING SYSTEMS AND METHODS FOR MECHANICALLY STABILIZED EARTHEN WALLS

(71) Applicant: SSL, LLC, Scotts Valley, CA (US)

(72) Inventor: Steven V. Ruel, Scotts Valley, CA (US)

(73) Assignee: SSL, LLC, Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/103,832

(22) Filed: Aug. 14, 2018

(65) Prior Publication Data

US 2018/0347141 A1 Dec. 6, 2018

Related U.S. Application Data

(63) Continuation of application No. 15/391,707, filed on Dec. 27, 2016, now Pat. No. 10,047,492.

(60) Provisional application No. 62/271,766, filed on Dec. 28, 2015.

(51) Int. Cl.
*E02D 29/02* (2006.01)

(52) U.S. Cl.
CPC ..... *E02D 29/0233* (2013.01); *E02D 29/0266* (2013.01); *E02D 2300/002* (2013.01); *E02D 2600/30* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,324,508 | A | 4/1982 | Hilfiker et al. | |
| 5,190,413 | A | 3/1993 | Carey | |
| 5,259,704 | A * | 11/1993 | Orgorchock | E02D 29/0225 405/262 |
| 6,086,288 | A | 7/2000 | Ruel et al. | |
| 6,113,317 | A | 9/2000 | Myers | |
| 6,685,400 | B1 | 2/2004 | Ruel et al. | |
| 6,793,436 | B1 | 9/2004 | Ruel et al. | |
| 6,860,681 | B2 | 3/2005 | Ruel | |
| 6,908,263 | B1 | 6/2005 | Ruel et al. | |
| 6,939,087 | B2 | 9/2005 | Ruel | |
| 7,503,719 | B1 | 3/2009 | Ruel et al. | |
| 7,722,296 | B1 | 5/2010 | Taylor | |
| 7,857,540 | B2 | 12/2010 | Ruel et al. | |

(Continued)

*Primary Examiner* — Kyle Armstrong
(74) *Attorney, Agent, or Firm* — Michael R. Schacht; Schacht Law Office, Inc.

(57) ABSTRACT

An anchoring system for a mechanically stabilized earthen structure having an earthen structure and at least one reinforced concrete wall panel having a concrete portion and a rebar structure. The anchoring system has at least one anchor pocket, at least one anchor structure, and at least one anchor strap. The at least one anchor pocket is arranged within the concrete portion of the at least one reinforced concrete wall panel. The at least one anchor structure has at least one anchor portion. The at least one anchor structure is arranged within the concrete portion of the at least one reinforced concrete wall panel such that the at least one anchor portion is accessible within the at least one anchor pocket. The at least one anchor strap that engages the earthen structure and the at least one anchor portion.

20 Claims, 8 Drawing Sheets

(56) References Cited

U.S. PATENT DOCUMENTS

| | | | | |
|---|---|---|---|---|
| 8,307,601 | B2 * | 11/2012 | Bonelli | E04B 1/04 403/305 |
| 8,696,250 | B2 | 4/2014 | Ruel | |
| 8,764,348 | B2 | 7/2014 | Ruel | |
| 10,047,492 | B1 | 8/2018 | Ruel | |
| 2013/0136544 | A1 | 5/2013 | McKittrick | |

* cited by examiner

ANCHORING SYSTEMS AND METHODS FOR MECHANICALLY STABILIZED EARTHEN WALLS

RELATED APPLICATIONS

This application, is a continuation of U.S. patent application Ser. No. 15/391,707 filed Dec. 27, 2016, currently pending.

U.S. patent application Ser. No. 15/391,707 claims benefit of U.S. Provisional Application Ser. No. 62/271,766 filed Dec. 28, 2015.

The contents of all related applications are incorporated herein by reference.

TECHNICAL FIELD

The present invention relates to anchoring systems for mechanically stabilized earthen walls and, in particular, to anchoring systems and methods adapted to stabilize concrete structural walls.

BACKGROUND

Construction projects often require that the earth be excavated to define a cut surface that is vertical or nearly vertical. Depending upon the characteristics of the earth at the point where the cut surface is formed, a wall system may be used to stabilize the earth at the cut surface. The wall system used to stabilize the earth is often referred to as a mechanically stabilized earthen (MSE) wall.

A mechanically stabilized earthen wall typically comprises a structural wall designed to remain upright to stabilize the earth at the cut surface. The structural wall may comprise stacked wall components such as stones, concrete blocks, or concrete panels or may be formed of a solid wall structure such as a cast-in-place concrete wall.

Depending on factors such as the height of the structural wall, the material forming the earth at the cut surface, and the loads to which the structural wall may be subjected, an anchoring system may be formed to further stabilize the structural wall. The anchoring system is typically connected to the structural wall and extends back into the earth to inhibit movement of the structural wall relative to the earth.

The need thus exists for improved anchoring systems and methods for mechanically stabilized earthen walls.

SUMMARY

The present invention may be embodied as a reinforced concrete wall panel that engages at least one anchor strap to stabilize an earthen structure, the concrete wall panel comprising a concrete portion, a rebar structure at least partly within the concrete portion, and an anchoring system. The anchoring system comprises at least one anchor pocket arranged within the concrete portion, at least one anchor structure comprising at least one anchor portion, at least one primary anchor member, and at least one secondary anchor member. The at least one primary anchor member and the at least one secondary member are arranged to circumscribe at least one of the anchor pockets. The at least one anchor structure is arranged within the concrete portion such that the at least one anchor portion is accessible within the at least one anchor pocket. Each anchor portion is adapted to engage the at least one anchor strap.

The present invention may also be embodied as a method of engaging at least one anchor strap to stabilize an earthen structure comprising the following steps. A rebar structure is provided and an anchoring system are provided. The anchoring system comprises at least one anchor pocket arranged within the concrete portion of the at least one reinforced concrete wall panel and at least one anchor structure comprising at least one anchor portion, at least one primary anchor member, and at least one secondary anchor member. The at least one anchor portion is adapted to engage the at least one anchor strap. A concrete structure is formed to define at least one anchor pocket such that the at least one primary anchor member and the at least one secondary member are arranged to circumscribe at least one of the anchor pockets and the at least one anchor structure is arranged within the concrete portion such that the at least one anchor portion is accessible within the at least one anchor pocket.

The present invention may also be embodied as a reinforced concrete wall panel that engages at least one anchor strap to stabilize an earthen structure comprising a concrete portion, a rebar structure, and an anchoring system. The rebar structure is at least partly within the concrete portion. The anchoring system comprising at least one anchor pocket arranged within the concrete portion of the at least one reinforced concrete wall panel and at least one anchor structure comprising at least one anchor portion, at least one primary anchor member, and at least one secondary anchor member. The at least one anchor pocket defines a terminal wall, an opening lateral dimension, a terminal lateral dimension adjacent to the terminal wall, an opening vertical dimension, and a terminal vertical dimension adjacent to the terminal wall. The opening lateral dimension is larger than the terminal lateral dimension, the terminal lateral dimension is larger than a width of the at least one anchor strap, and the opening vertical dimension is larger than the terminal vertical dimension. Each anchor portion is adapted to engage the at least one anchor strap.

DETAILED DESCRIPTION

Figure 1:
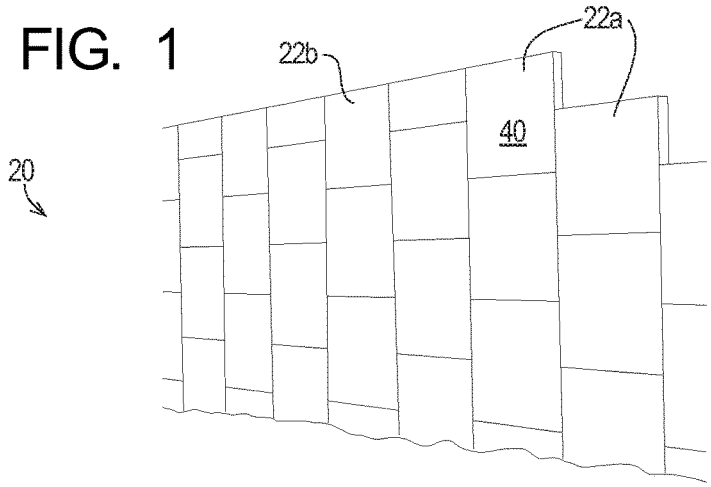
FIG. 1 is front elevation view of a first example wall system constructed in accordance with, and embodying, the principles of the present invention.

Referring initially to FIG. 1 of the drawing, depicted therein is a first example wall system 20 constructed in accordance with, and embodying, the principles of the present invention. The first example wall system 20 comprises one or more full wall panels 22*a*, one or more half wall panels 22*b*, and, as perhaps best shown in FIGS. 2-12, a first example anchor system 24. The first example anchor system 24 engages the wall panels 22*a* and 22*b* and an earthen structure 26 to stabilize the first example wall system 20.

In the following discussion, the terms "vertical", "horizontal", "side", "top", "bottom" generally refer to those directions when the first example wall system 20 is installed and in use. The term "front" refers to a side of the wall panels 22*a* and/or 22*b* facing away from the earthen structure 26, and the term "rear" refers to a side of the wall panels 22*a* and/or 22*b* facing the earthen structure 26.

A wall system 20 of the present invention need not employ both full wall panels 22*a* and half wall panels 22*b*. However, the use of both full wall panels 22*a* and half wall panels 22*b* may be desirable to create staggered joints between horizontally adjacent wall panels and even upper and lower wall edges. As will be described below, the principles of the present invention may be applied to a wall system employing only full wall panels 22*a*, only half wall panels 22*b*, and a combination of full wall panels 22*a* and half wall panels 22*b* as employed by the first example wall system 20. In the following discussion, only the full wall panels 22*a* will be described in detail.

Each of the wall panels 22*a* comprises a concrete portion 30 in which is embedded a rebar structure 32 and one or more lifting members 34. One primary purpose of the rebar structure 32 is to reinforce the panels 22*a* and/or 22*b*. Concrete portions reinforced with rebar structures and provided with lifting members are generally known, so the example portion 30, rebar structure 32, and lifting members 34 will be described herein only to the extent necessary for a complete understanding of the present invention. The rebar structure 32 is embedded within the concrete portion 30 by pouring wet concrete into a form around the rebar structure 32 and allowing the wet concrete to cure to form the concrete portion 30.

Each of the wall panels 22*a* defines a front face 40, a rear face 42, and first, second, third, and fourth edge portions 44*a*, 44*b*, 44*c*, and 44*d*. The front and rear faces 40 and 42 are generally planar but one or both of these faces 40 and 42 may be textured, stamped, or otherwise formed with decorative or functional features. The edges 44*a*, 44*b*, 44*c*, and 44*d* may be keyed to enhance stability of the first example wall system 20. In particular, the example first and third edges 44*a* and 44*c* may be provided with projections, and the second and fourth edges 44*b* and 44*d* may be provided with recesses sized and dimensioned to receive the projections. The edges 44*a*, 44*b*, 44*c*, and 44*d* and any mechanical engagement between any two edges (e.g., 44*a* and 44*c* or 44*b* and 44*d*) of adjacent wall panels 22*a* is not a part of the present invention. A panel thickness ST is defined between the front face 40 and the rear face 42. The remaining dimensions of the wall panels 22*a* are not per se part of the present invention and may be industry standard.

FIGS. 4-8 illustrate the rebar structure 32 of the example wall panel 22*a* in further detail. As perhaps best shown in FIG. 8, the example rebar structure 32 comprises a plurality of horizontal rebar members 50 and a plurality of vertical rebar members 52 and defines a plurality of rebar openings 54 surrounded by two of the horizontal rebar members 50 and two of the vertical rebar members 52. The horizontal and vertical rebar members 50 and 52 are typically welded, tied, integrally formed with each other, or otherwise secured in a grid to form the rebar structure 32. The use of a welded rebar structure 32 to reinforce the concrete portion 30 is well known, and the particulars of the example rebar structure 32 are of relevance to the present invention only in the placement of the rebar openings 54 as will be described in further detail below.

Figure 2:
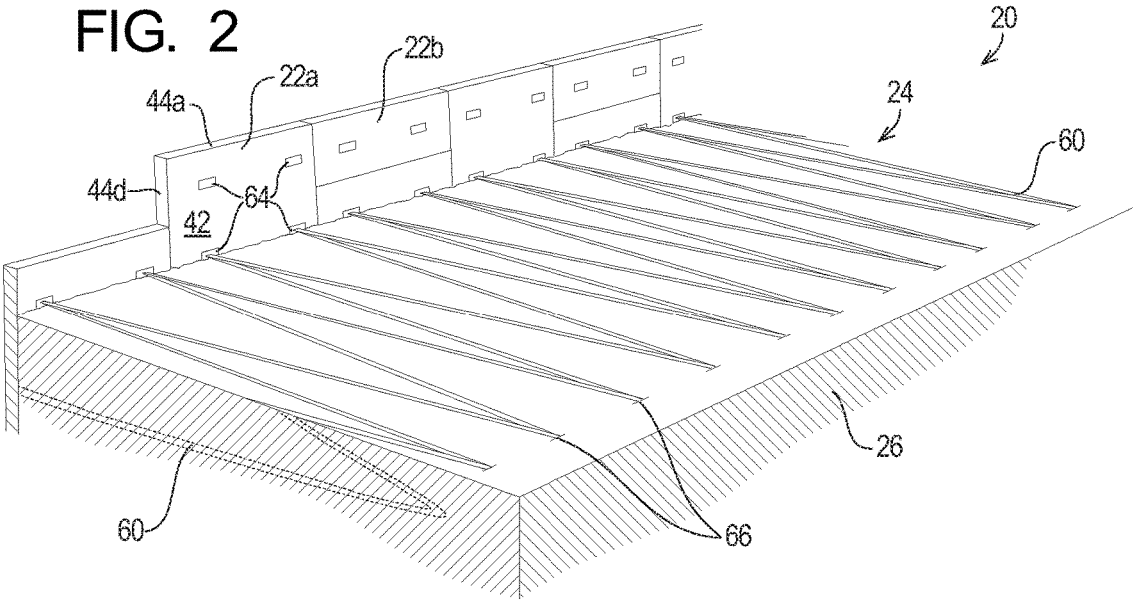
FIG. 2 is a rear perspective view depicting a stage in the process of forming a first anchor system of the first example wall system.

The first example anchor system 24 comprises one or more anchor straps 60, one or more anchor structures 62, one or more anchor pockets 64, and, optionally, one or more strap pins 66 (FIG. 2). To form the first example anchor system 24, the example anchor strap 60 is arranged at least partly within one or more of the anchor pockets 64 around an anchor portion 68 (FIG. 4) of at least one of the anchor structures 62 and at least partly within the earthen structure 26. The strap or straps 60 and the anchor structure or structures 62 thus form part of the anchor system 24 that reinforces the soil forming the earthen structure 26. If used, the strap pins 66 may secure the anchor strap 60 in a desired relationship with the earthen structure 26 during formation of the anchor system 24 and while the wall system 20 is operating to stabilize the earthen structure 26.

With the one or more anchor straps 60 extending between one or more of the wall panels 22*a* and the earthen structure 26, loads on the rear face 42 of the wall panels 22*a* directed towards the front face 40 thereof are transferred through at least a portion of the concrete portion 30, through at least a portion of the rebar structure 32, through at least part of the anchor portion 68 of the anchor structure 62, through the anchor strap 60, and into the earthen structure 26 in which the anchor strap 60 is buried. The optional strap pins 66 will further transmit loads on the anchor strap 60 into the earthen structure 26.

Referring now to FIGS. 2-7 and 9-12, the construction and formation of the first example anchor system 24 will now be described in further detail. The first example anchor system 24 comprises two anchor straps 60 arranged in first and second vertical levels (FIG. 2), two anchor structures 62 within each of multiple full wall panels 22*a* (FIGS. 4-7 and 9-12), and two pairs of anchor pockets 64 arranged at first and second vertical levels (FIGS. 2 and 4-12) in each of the full wall panels 22*a*.

Figure 3:
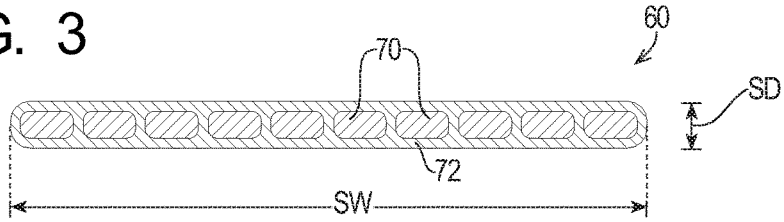
FIG. 3 is a section view of a first example anchor strap that may be used part of the first example anchor system of the first example wall system.

As shown in FIG. 3, each anchor strap 60 comprises tendons 70 surrounded by a sheath 72. The anchor strap 60 is or may be conventional and will be described herein only to that extent necessary for a complete understanding of the present invention. The example anchor strap 60 defines a strap width SW and a strap depth SD.

Along with the rebar structure 32 described above, the one or more anchor structure(s) 62 is/are embedded within the concrete portion 30 by pouring wet concrete into a form around the anchor structure 62 (and the rebar structure 32) and allowing the wet concrete to cure to form the concrete portion 30.

Each of the example anchor structures 62 comprises at least two horizontal anchor members 80, at least two vertical anchor members 82, and at least one pin member 84. The horizontal anchor members 80, vertical anchor members 82, and pin member 84 are welded, tied, integrally formed with each other, or otherwise secured to each other to form a rigid structure that may be easily handled prior to and during formation of the wall panels 22*a* and 22*b* and which transfers loads through the wall panels 22*a* and 22*b* as required by the operational requirements of the wall panels 22*a* and 22*b* and the wall system 20. The terms "first anchor member", "second anchor member", "primary anchor member", and "secondary anchor member" may be used herein to refer to any of the anchor members forming part of an anchor structure of the present invention without using the directional terms "horizontal" and "vertical" or the angular relationships suggested by the terms "horizontal" and "vertical".

Figure 9:
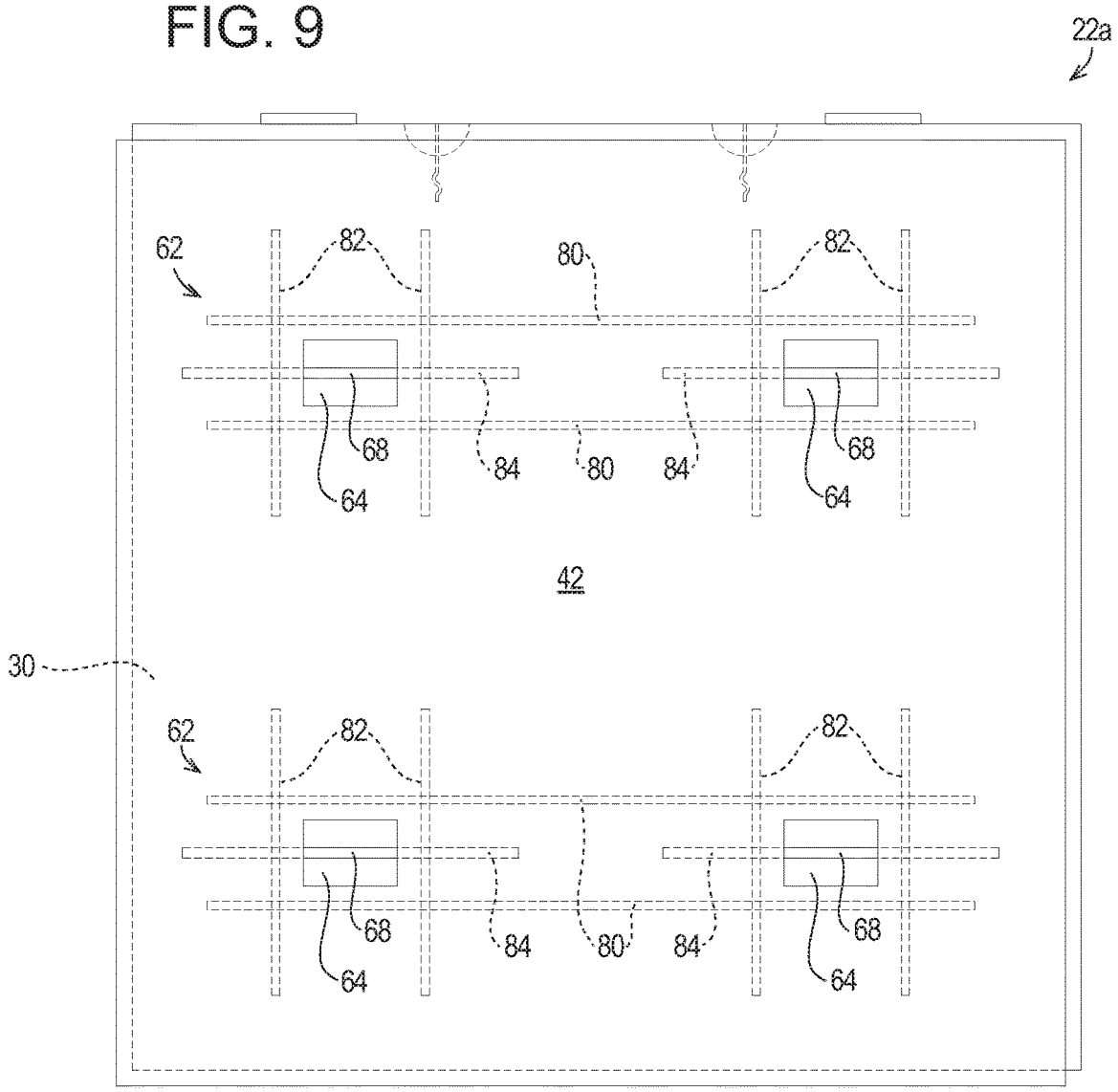
FIG. 9 is a rear elevation view of the first example full wall panel showing, for clarity, only a first anchor structure thereof.

As perhaps best shown in FIG. 9, the example anchor structure 62 comprises two horizontal anchor members 80, four vertical anchor members 82, and two anchor pin members 84. The example anchor system 24 employs two separate anchor structures 62 within each of multiple full wall panels 22*a* and a single anchor structure 62 within each of multiple half wall panels 22*b*. The configuration, number, and location of the anchor structures within a given wall panel will be determined by the operating requirements of the wall panels and the wall system formed thereby. For example, an anchor structure of the present invention may include more than two horizontal anchor members or more two vertical anchor members.

The anchor pockets 64 are each defined by a first side wall 90, a second side wall 92, a top wall 94, a bottom wall 96, and a terminal wall 98. The example first and second side walls 90 and 92, the example top wall 94, and the example bottom wall 96 are substantially planar, while the terminal wall 98 is generally semi-cylindrical. The anchor pockets 64 each define an opening lateral dimension OLD, an opening vertical dimension OLD, a terminal lateral dimension TLD, a terminal vertical dimension TVD, and a pocket depth PD. Each of the example full wall panels 22*a* defines four of the anchor pockets 64, while each of the example half wall panels 22*b* defines two anchor pockets 64. The configuration, number, and location of the anchor pockets within a given wall panel will be determined by the operating requirements of the wall panels and the wall system formed thereby. Typically, the anchor pockets 64 will be sized, dimensioned, and located to transfer loads from the anchor strap 60 evenly to the rear face 42 of the concrete portion 30 when loads are applied to the rear face 42.

As shown in FIGS. 4-7 and 9, the example anchor pockets 64 and anchor structures 62 are arranged relative to each other such each anchor pocket 64 is at least partly surrounded by at least one of the anchor structures 62, with at least one anchor portion 68 of the anchor structures 62 exposed within each of the anchor pockets 64. In particular, one of the vertical anchor members 82 is arranged on each side of each anchor pocket 64, one of the horizontal anchor members 80 is arranged above each anchor pocket 64, one of the horizontal anchor members 80 is arranged below each anchor pocket 64, and the anchor pin member 84 extend between the vertical anchor members 82 one either side of the anchor pocket 64 and through the anchor pocket 64 such that an exposed portion of the anchor pin member 84 forms the anchor portion 68 of the anchor structure 62.

In the example anchor structure 62, first and second horizontal anchor members 80 are arranged above and below, respectively, two of the anchor pockets 64, a first vertical anchor member 82 is arranged outside of one of the anchor pockets 64, second and third vertical anchor members 82 are arranged between the two anchor pockets 64, a fourth anchor members 82 is arranged outside another one of the anchor pockets 64, and first and second anchor pin members 84 are each arranged parallel to and equally spaced between the two horizontal anchor members 80 such that the first anchor pin member 84 is in contact with the first and second vertical anchor members 82 and the second anchor pin 84 is in contact with the third and fourth vertical anchor members 82. The configuration of the example anchor structure 62 is such that a pair of the example anchor structures 62 may be used to form the full wall panels 22*a* and a single one of the example anchor structures 62 may be used to form the half wall panels 22*b*.

Figure 4:
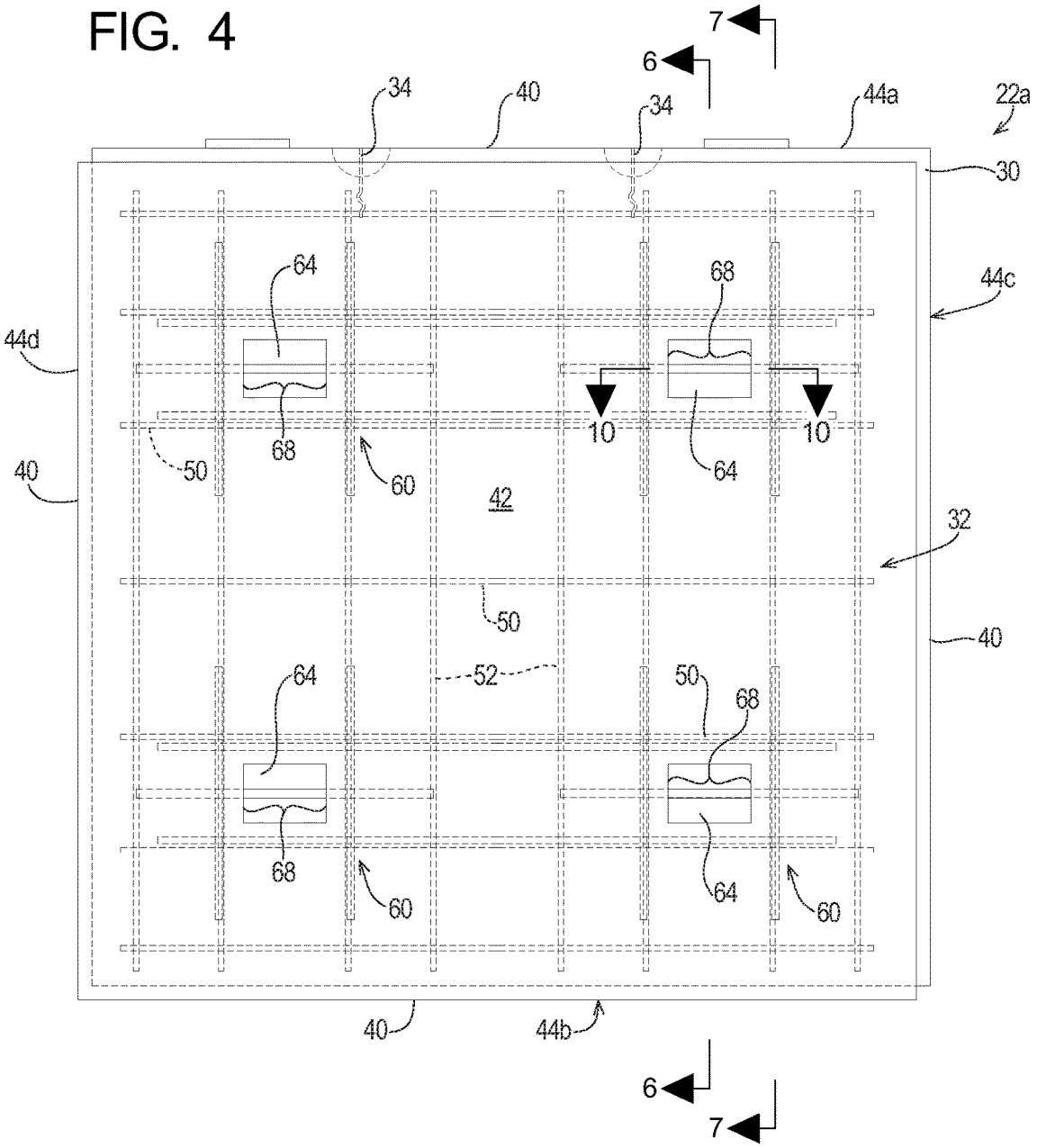
FIG. 4 is a rear elevation view of a first example full wall panel that may be used as part of the first example wall system.
Figure 6:
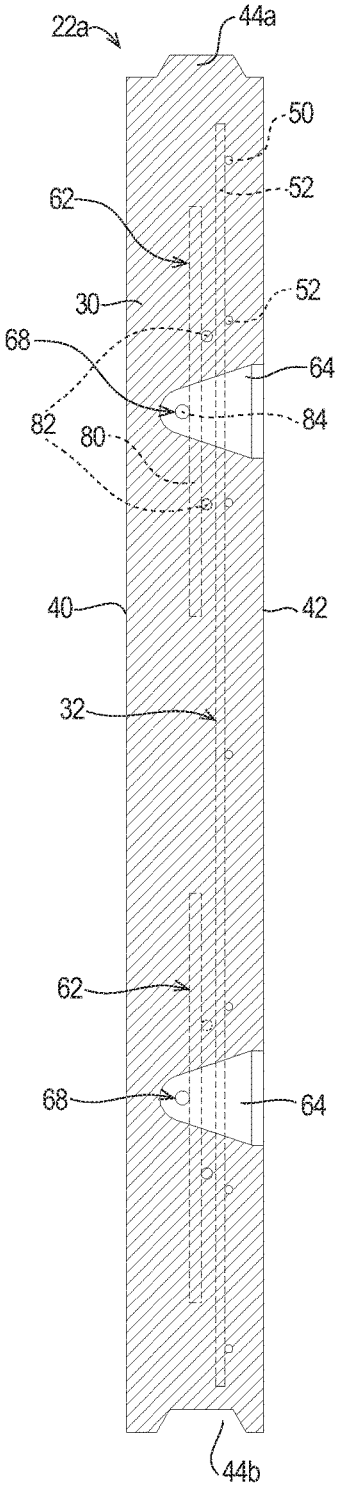
FIG. 6 is a side section view taken along lines 6-6 in FIG. 4.
Figure 7:
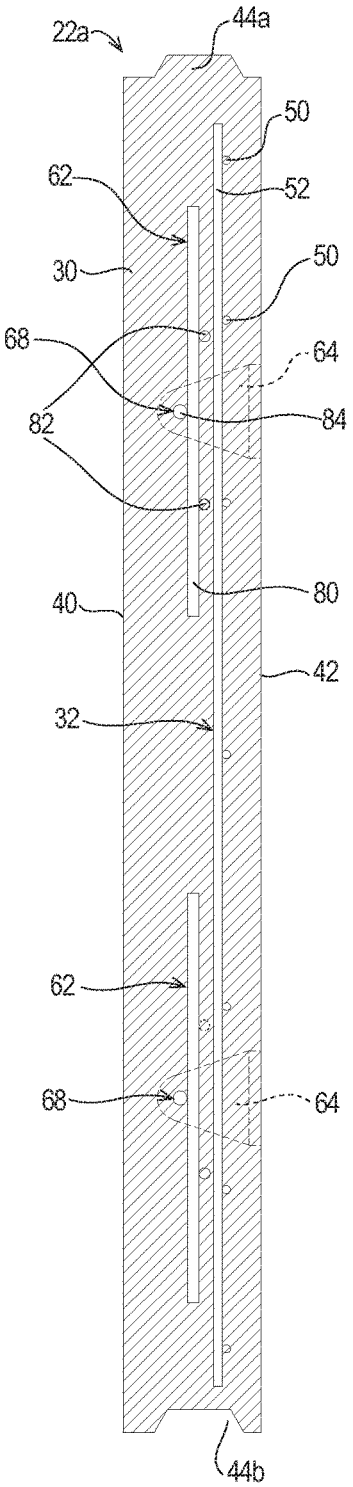
FIG. 7 is a side section view taken along lines 7-7 in FIG. 4.
Figure 8:
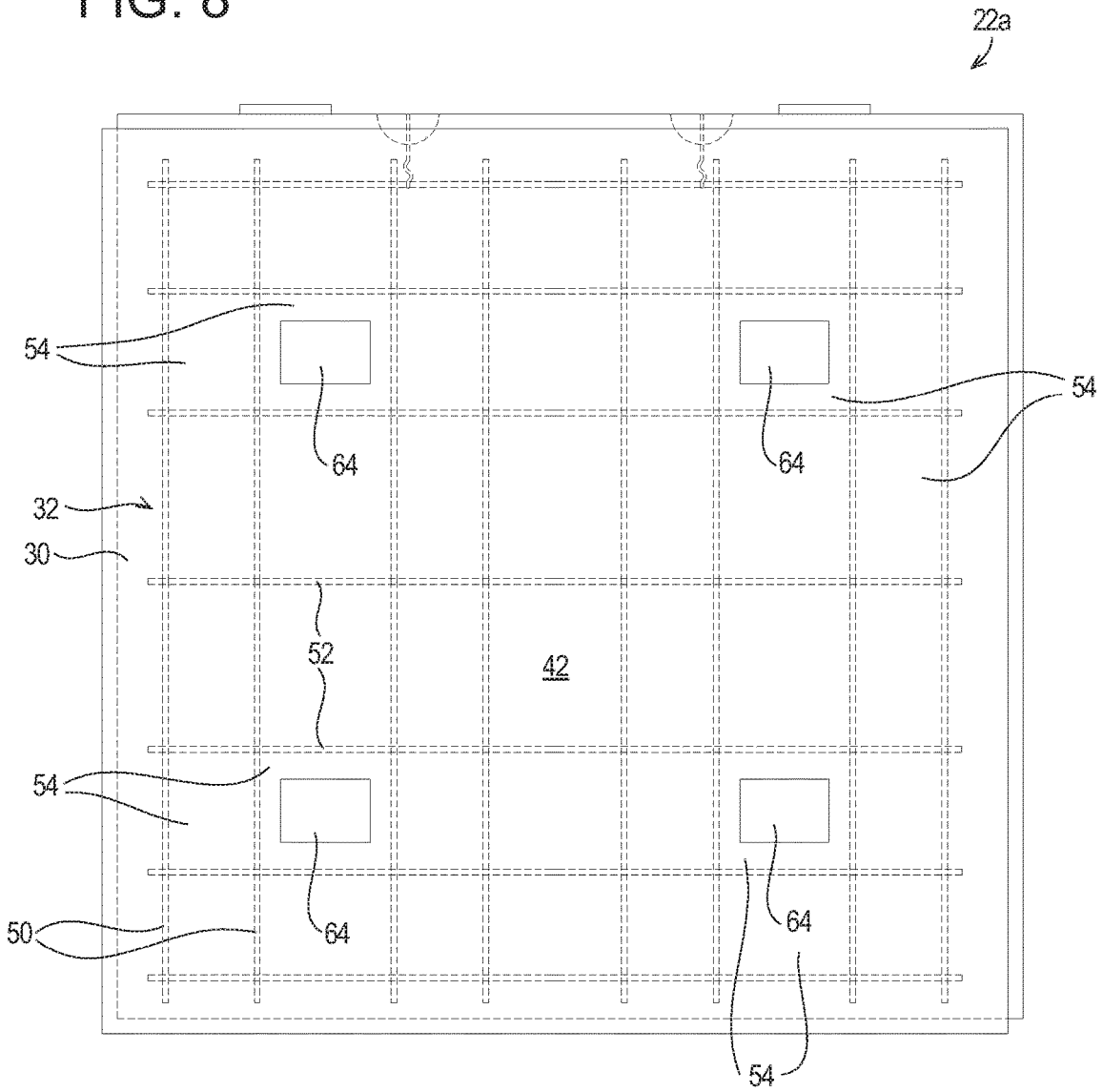
FIG. 8 is a rear elevation view of the first example full wall panel showing, for clarity, only a rebar structure thereof.

As perhaps best shown in FIGS. 4-7 and 8, the example anchor pockets 64 are also arranged to be at least partly be within one of the rebar openings 54 defined by the rebar structure 32. In particular, one of the vertical rebar members 52 is arranged on each side of each anchor pocket 64, one of the horizontal rebar members 50 is arranged above each anchor pocket 64, and one of the horizontal rebar members 50 is arranged below each anchor pocket 64. The example rebar structure 32 as depicted in FIGS. 4 and 8 employs seven of the horizontal rebar members 50 and eight of the vertical rebar members 52. The configuration of the rebar structure within a given wall panel will be determined by configuration, number, and location of the anchor structures and the anchor pockets and by the operating requirements of the wall panels and the wall system formed thereby.

The rebar structure 32 and the anchor structure(s) 62 are substantially planar and are embedded within the concrete portion 30 such that the planes defined by the rebar structure 32 and anchor structure 62 are parallel to each other. In the example wall panels 22*a* and 22*b*, the rebar structure 32 and the anchor structure(s) 62 are spaced from and parallel to at the front face 40 and the rear face 42.

More specifically as best shown in FIG. 4, the example anchor structure or structures 62 are arranged such that each horizontal anchor member 80 is substantially aligned with at least a portion of one of the horizontal rebar members 50 and each vertical anchor member 82 is substantially aligned with at least a portion of one of the vertical rebar members 52. However, the horizontal anchor members 80 may be offset from the horizontal rebar members 50, and the vertical anchor members 82 may be offset from the vertical rebar members 52.

Figure 5:
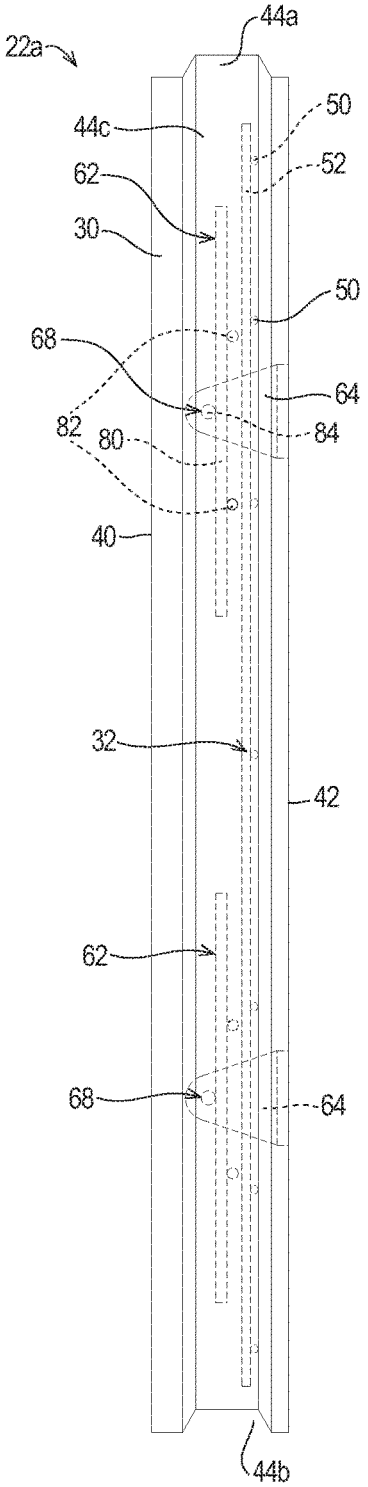
FIG. 5 is a side elevation view of the first example full wall panel.

Further, FIGS. 5-7 show that the example anchor structure(s) 62 are arranged such that the anchor structure(s) 62 are between the rebar structure 32 and the front face 40 of the concrete portion 30.

The example anchor structure(s) 62 are further arranged such that the anchor pin member(s) 84 are between the vertical anchor members 82 and the front face 40 of the concrete portion 30 and such that the horizontal anchor members 80 are arranged between the vertical anchor members 82 and the rebar structure 32. In the example wall panels 22*a* and 22*b*, the horizontal rebar members 50 are arranged between the vertical rebar members 52 and the rear face 42 of the concrete portion 30.

Accordingly, from the rear face 42 to the front face 40, successive spaced vertical planes defined relative to the example wall panels 22*a* and 22*b* include the horizontal rebar members 50, the vertical rebar members 52, the horizontal anchor members 80, the vertical anchor members 82, and the pin member(s) 84.

Figure 10:
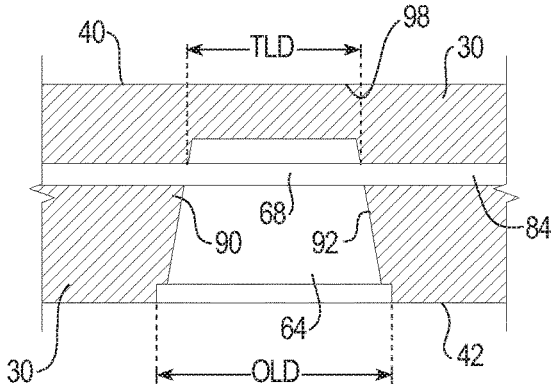
FIG. 10 is a top section view taken along lines 10-10 in FIG. 4.
Figure 11:
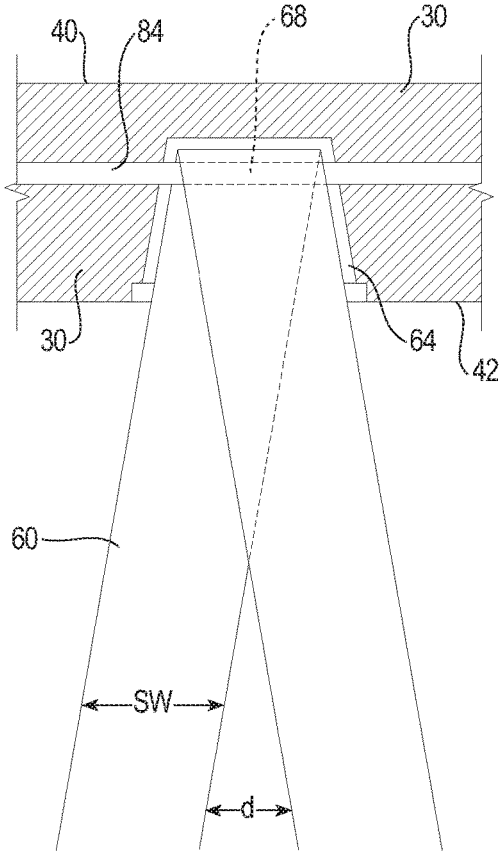
FIG. 11 is a top section view similar to FIG. 10 illustrating the engagement of the first example wall strap with an anchor structure of the first example full wall panel.
Figure 12:
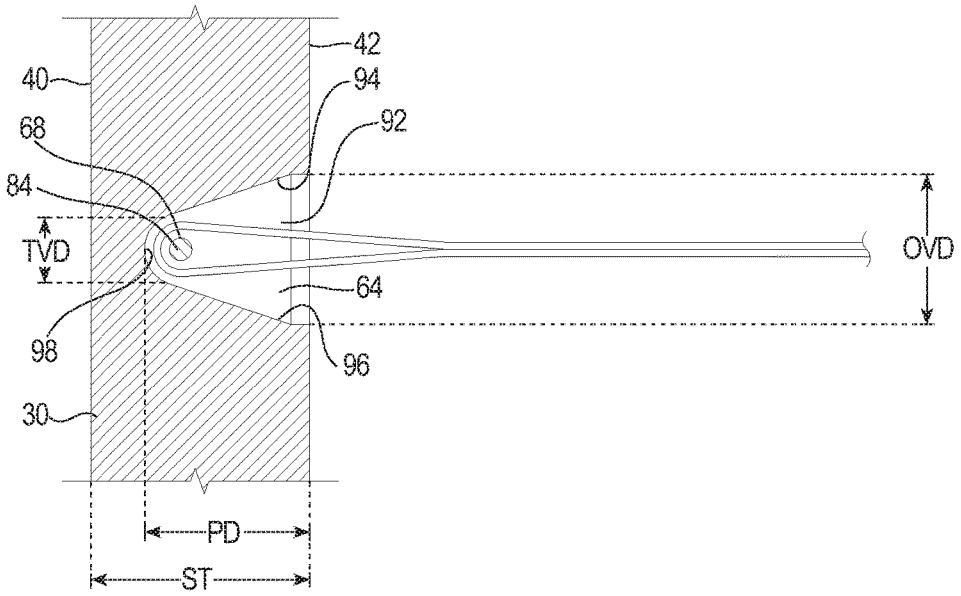
FIG. 12 is a side elevation section view illustrating the engagement of the first example wall strap with the anchor structure of the first example full wall panel.

Further, as shown in FIGS. 5-7 and even more specifically in FIGS. 10-12, the anchor pockets 64 extend from the rear face 42 towards the front face 40 of the concrete portion 30 a distance equal to the pocket depth PD. Also, the pocket depth PD is sized such that the terminal wall 98 is spaced farther from the rear face 42 than the anchor pin member(s) 84. The anchor pin member(s) 84 thus pass through the void in the concrete portion 30 defined by the anchor pocket(s) 64; the portion of the anchor pin member(s) 84 exposed within the anchor pocket(s) 64 defines at least one anchor portion 68 of the anchor structure 62. The panel thickness ST, pocket depth PD, and locations of the rebar structure 32 and anchor structure 62 are determined such that the concrete portion 30 has sufficient strength to bear the loads for which the first example wall system 20 is defined.

Conventionally, the rebar members 50 and 52 forming the rebar structure 32 are steel reinforcing bars but can be made of any material capable of providing the structural strength required of the wall panels 22*a* and 22*b*. The anchor members 80 and 82 forming the anchor structure 62 may be steel reinforcing bars but can be made of any material capable of providing the structural strength required of the anchor system 24. Because at least the anchor portion 68 of the anchor structure 62 may be exposed to the elements and/or groundwater during normal use of the anchor system 24, the anchor portion 68 may be coated before or after the anchor structure 62 is embedded within the concrete portion 30. Alternatively, other materials such as plastics or fiber (carbon or glass) reinforced plastics may be used to reduce corrosion of the exposed anchor portion 68.

Further, the anchor pockets 64 are sized, dimensioned, and configured to minimize the void in the concrete portion 30 while still accommodating the anchor strap 60 as shown in FIGS. 11 and 12. FIG. 11 illustrates that the first and second side walls 90 and 92 are spaced from each other a distance at least equal to the strap width SW. In particular, the example first and second side walls 90 and 92 are slanted such that the anchor pocket(s) 64 narrow from the rear face 42 to the terminal wall 98 as shown in FIGS. 10 and 11. This narrowing accommodates the angle formed by the anchor strap 60 in its zig-zag configuration when embedded within the earthen structure 26 yet minimizes dimensions of the void in the concrete portion 30. FIG. 12 illustrates that the top and bottom walls 94 and 96 are spaced from each other a distance at least equal to the strap depth SD. In particular, the example top and bottom walls 94 and 96 are slanted such that the anchor pocket(s) 64 narrow from the rear face 42 to the terminal wall 98 as shown in FIG. 12. This narrowing of the vertical dimensions of the anchor pocket(s) 64 facilitates passing of a bitter end of the anchor strap 60 through around the anchor portion 68 during formation of the anchor system 24 yet minimizes dimensions of the void in the concrete portion 30.

Figure 13:
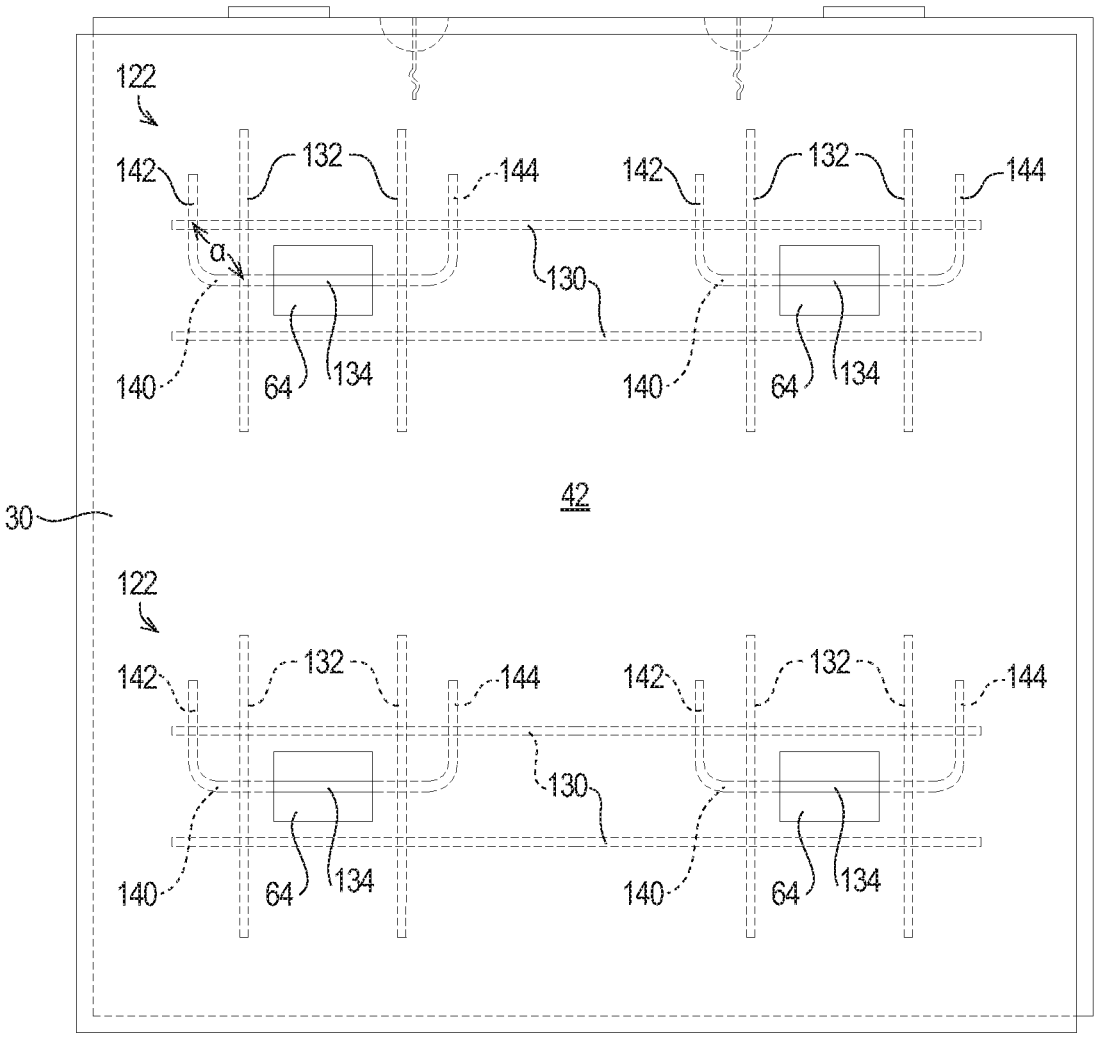
FIG. 13 is a rear elevation view of a second example full wall panel showing, for clarity, only a second anchor structure thereof.

Referring now to FIG. 13 of the drawing, depicted therein is a full wall panel 120 comprising a pair of second example anchor structures 122 constructed in accordance with, and embodying, the principles of the present invention. The example wall panel 120 is a full wall panel comprising two separate anchor structures 122, but a single anchor structure 122 may be used by a half wall panel. The configuration, number, and location of the anchor structures 122 within a given wall panel will be determined by the operating requirements of the wall panels and the wall system formed thereby. Like the anchor structure 62, the anchor structure 122 is embedded within the example concrete portion 30 defining the anchor pockets 64 and comprising a reinforcing structure (not shown) like the reinforcing structure 32 described above. The concrete portion 30, anchor pockets 64, and reinforcing structure will not be described again herein.

The example anchor structure(s) 122 each comprise comprises at least two horizontal anchor members 130, at least two vertical anchor members 132, and at least one pin member 134. The horizontal anchor members 130, vertical anchor members 132, and pin member 134 are welded, tied, integrally formed with each other, or otherwise secured to each other to form a rigid structure that may be easily handled prior to and during formation of the wall panel 120 and which transfers loads through the wall panel 120 as required by the operational requirements of the wall panel 120 and the wall system 20.

FIG. 13 further shows that the example anchor structure 122 comprises two horizontal anchor members 130, four vertical anchor members 132, and two anchor pin members 134. The horizontal anchor members 130, vertical anchor members 132, and anchor pin members 134 are arranged relative to each other, the anchor pockets 64, and the rear face 42 in a manner similar to that of the horizontal anchor members 80, vertical anchor members 82, and anchor pin members 84 described above.

However, the example anchor pin members 134 each define a central portion 140, a first end portion 142, and a second end portion 144. The central portion 140 extends through the anchor pocket 64, spans the distance between adjacent vertical anchor members 132, and is parallel to and equally spaced between the two horizontal anchor members 130. The end portions 142 and 144 are angled with respect to the central portion 140 and extend up from the central portion 140 such that the end portions 142 and 144 cross the uppermost of the horizontal anchor members 130. Loads on the anchor pin members 134 are thus transferred within the concrete portion 30 to both one of the horizontal anchor members 130 and two of the vertical anchor members 132.

Figure 14:
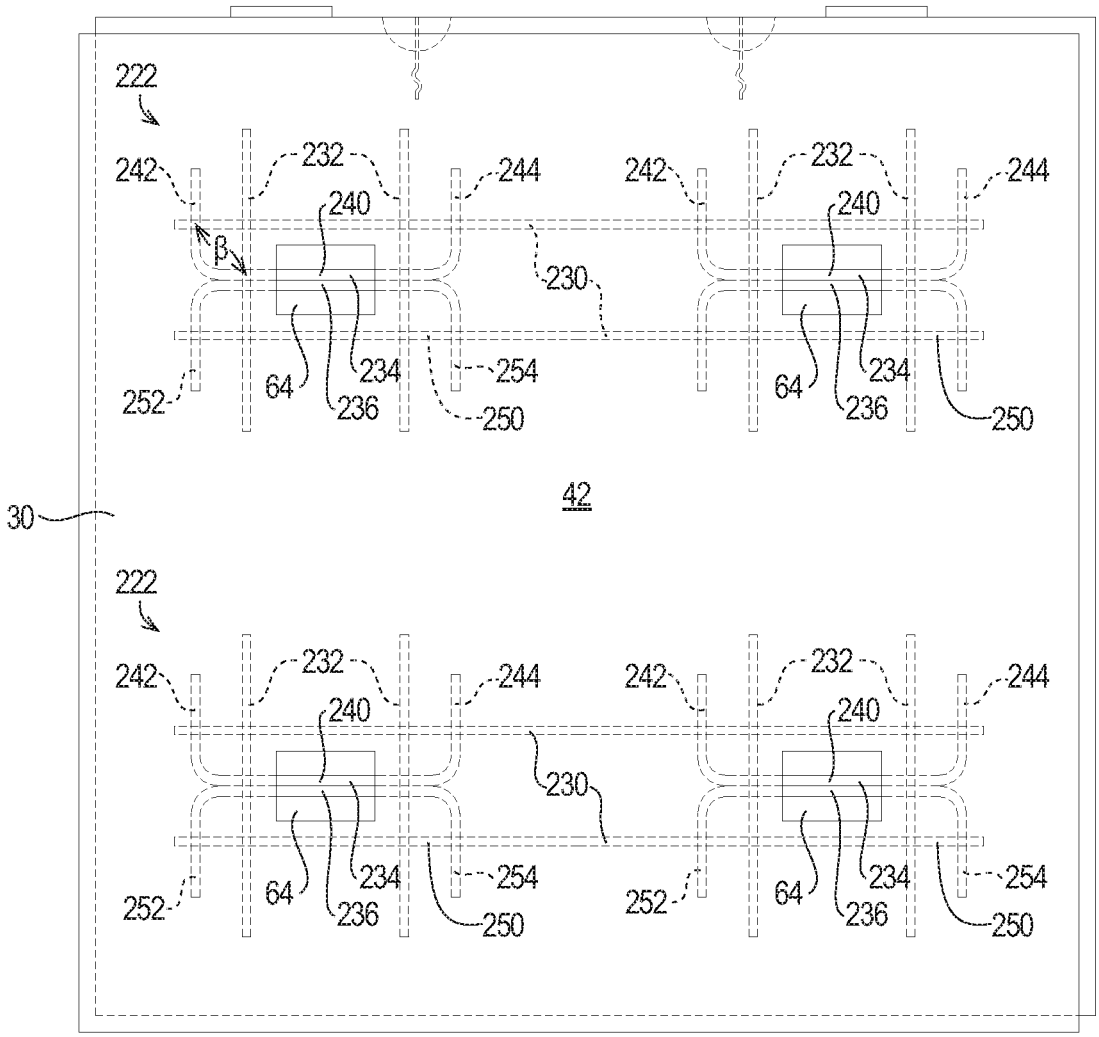
FIG. 14 is a rear elevation view of a third example full wall panel showing, for clarity, only a third anchor structure thereof.

The angle $\alpha$ at which the example end portions 142 and 144 extend with respect to the central portion 140 can vary from the substantially 90° angle depicted in FIG. 13. For example, analogous end portions of the example anchor pin members 84 extend at an angle of substantially 180° with respect to the analogous central portion of the example anchor pin members 84. The example angle $\alpha$ between the end portions 142 and 144 and the central portions 140 is within a first range of between 85° and 95° but may be within a second range of substantially between 85° and 180° and in any event should be within a third rage of substantially between 0° and 180°. The angle between the first end portion 142 and the central portion 140 may be different from the angle between the second end portion 144 and the central portion 140. Referring now to FIG. 14 of the drawing, depicted therein is a full wall panel 220 comprising a pair of third example anchor structures 222 constructed in accordance with, and embodying, the principles of the present invention. The example wall panel 220 is a full wall panel comprising two separate anchor structures 222, but a single anchor structure 222 may be used by a half wall panel. The configuration, number, and location of the anchor structures 222 within a given wall panel will be determined by the operating requirements of the wall panels and the wall system formed thereby. Like the anchor structures 62 and 122, the anchor structure 222 is embedded within the example concrete portion 30 defining the anchor pockets 64 and comprising a reinforcing structure (not shown) like the reinforcing structure 32 described above. The concrete portion 30, anchor pockets 64, and reinforcing structure will not be described again herein.

The example anchor structure(s) 222 each comprise comprises at least two horizontal anchor members 230, at least two vertical anchor members 232, at least one first pin member 234, and at least one second pin member 236. The horizontal anchor members 230, vertical anchor members 232, and pin members 234 and 236 are welded, tied, integrally formed with each other, or otherwise secured to each other to form a rigid structure that may be easily handled prior to and during formation of the wall panel 220 and which transfers loads through the wall panel 220 as required by the operational requirements of the wall panel 220 and the wall system 20 formed thereby.

FIG. 14 further shows that the example anchor structure 222 comprises two horizontal anchor members 230, four vertical anchor members 232, and two anchor pin members 234. The horizontal anchor members 230, vertical anchor members 232, and anchor pin members 234 are arranged relative to each other, the anchor pockets 64, and the rear face 42 in a manner similar to that of the horizontal anchor members 80, vertical anchor members 82, and anchor pin members 84 described above.

However, the example first anchor pin members 234 each define a central portion 240, a first end portion 242, and a second end portion 244 and the example second anchor pin members 236 each define a central portion 250, a first end portion 252, and a second end portion 254. The central portion 240 extends through the anchor pocket 64, spans the distance between adjacent vertical anchor members 232, and is parallel to and equally spaced between the two horizontal anchor members 230. The end portions 242 and 244 are angled with respect to the central portion 240 and extend up from the central portion 240 such that the end portions 242 and 244 cross the uppermost of the horizontal anchor members 230. Similarly, the central portion 250 extends through the anchor pocket 64, spans the distance between adjacent vertical anchor members 232, and is parallel to and equally spaced between the two horizontal anchor members 230. The end portions 252 and 254 are angled with respect to the central portion 250 and extend down from the central portion 250 such that the end portions 252 and 254 cross the lower most of horizontal anchor members 230. Loads on the anchor pin members 234 are thus transferred within the concrete portion 30 to both of the horizontal anchor members 230 and two of the vertical anchor members 232.

The angle β at which the example end portions 242 and 244 extend with respect to the central portion 240 can vary from the substantially 90° angle depicted in FIG. 14. The example angle β between the end portions 242 and 244 and the central portions 240 is within a first range of between 85° and 95° but may be within a second range of substantially between 85° and 180° and in any event should be within a third rage of substantially between 0° and 180°. The angle between the first end portion 242 and the central portion 240 may be different from the angle between the second end portion 244 and the central portion 240.

What is claimed is:

1. A reinforced concrete wall panel that engages at least one anchor strap to stabilize an earthen structure, the concrete wall panel comprising:

a concrete portion;

a rebar structure at least partly within the concrete portion; and an anchoring system comprising:

at least one anchor pocket arranged within the concrete portion of the at least one reinforced concrete wall panel;

at least one anchor structure comprising at least one anchor portion, at least one primary anchor member, and at least one secondary anchor member, where the at least one primary anchor member and the at least one secondary member are arranged to circumscribe at least one of the anchor pockets, and the at least one anchor structure is arranged within the concrete portion such that the at least one anchor portion is accessible within the at least one anchor pocket; and each anchor portion is adapted to engage the at least one anchor strap.

2. The reinforced concrete wall panel as recited in claim 1, in which the rebar structure is arranged within the concrete portion between the at least one anchor structure and the earthen structure.

3. The reinforced concrete wall panel as recited in claim 1, in which:

a plurality of the anchor pockets is arranged within the concrete portion;

the at least one anchor structure comprises a plurality of anchor portions; and at least one of the anchor portions is accessible within each anchor pocket.

4. The reinforced concrete wall panel as recited in claim 1, in which:

a plurality of the anchor pockets is arranged within the concrete portion;

the at least one anchor structure comprises a plurality of anchor structures each defining an anchor portion; and at least one of the anchor portions is accessible within each anchor pocket.

5. The reinforced concrete wall panel as recited in claim 1, in which the at least one primary anchor member and the at least one secondary anchor member are arranged such that loads on the at least one anchor portion from the at least one anchor strap are transferred to the rebar structure through the at least one primary anchor member and the at least one secondary anchor member.

6. The reinforced concrete wall panel as recited in claim 1, in which the at least one anchor pocket defines a terminal wall, an opening lateral dimension, and a terminal lateral dimension adjacent to the terminal wall, wherein:

the opening lateral dimension is larger than the terminal lateral dimension; and the terminal lateral dimension is larger than a width of the at least one anchor strap.

7. The reinforced concrete wall panel as recited in claim 6, in which the at least one anchor pocket defines a terminal wall, an opening vertical dimension, and a terminal vertical dimension adjacent to the terminal wall, wherein the opening vertical dimension is larger than the terminal vertical dimension.

8. The reinforced concrete wall panel as recited in claim 1, in which:

the anchor strap defines an angle when engaged with the at least one anchor portion and the earthen structure; and the at least one anchor pocket defines first and second walls that are angled with respect to each other to accommodate the angle formed by the anchor strap.

9. The reinforced concrete wall panel as recited in claim 6, in which the at least one anchor portion is defined by a pin member that extends through the at least one anchor pocket adjacent to the terminal wall.

10. A method of engaging at least one anchor strap to stabilize an earthen structure, the method comprising the steps of:

providing a rebar structure; and providing an anchoring system comprising:

at least one anchor pocket arranged within the concrete portion of the at least one reinforced concrete wall panel;

at least one anchor structure comprising at least one anchor portion, at least one primary anchor member, and at least one secondary anchor member, where the at least one anchor portion is adapted to engage the at least one anchor strap;

forming a concrete structure defining at least one anchor pocket such that the at least one primary anchor member and the at least one secondary member are arranged to circumscribe at least one of the anchor pockets, and the at least one anchor structure is arranged within the concrete portion such that the at least one anchor portion is accessible within the at least one anchor pocket.

11. The method as recited in claim 10, further comprising the step of arranging the rebar structure within the concrete portion between the at least one anchor structure and the earthen structure.

12. The method as recited in claim 10, in which:

a plurality of the anchor pockets is formed by the concrete portion;

the at least one anchor structure comprises a plurality of anchor portions; and the concrete structure is formed such that at least one of the anchor portions is accessible within each anchor pocket.

13. The method as recited in claim 10, in which:

a plurality of the anchor pockets is formed by the concrete portion;

the at least one anchor structure comprises a plurality of anchor structures each defining an anchor portion; and the concrete structure is formed such that at least one of the anchor portions is accessible within each anchor pocket.

14. The method as recited in claim 10, further comprising the step of arranging the at least one primary anchor member and the at least one secondary anchor member such that loads on the at least one anchor portion from the at least one anchor strap are transferred to the rebar structure through the at least one primary anchor member and the at least one secondary anchor member.

15. The method as recited in claim 10, in which the concrete portion is formed such that the at least one anchor pocket defines a terminal wall, an opening lateral dimension, and a terminal lateral dimension adjacent to the terminal wall, wherein:

the opening lateral dimension is larger than the terminal lateral dimension; and the terminal lateral dimension is larger than a width of the at least one anchor strap.

16. The method as recited in claim 15, in which the concrete portion is formed such that the at least one anchor pocket defines a terminal wall, an opening vertical dimension, and a terminal vertical dimension adjacent to the terminal wall, wherein the opening vertical dimension is larger than the terminal vertical dimension.

17. The method as recited in claim 15, further comprising the step of arranging a pin member to extend through the at least one anchor pocket adjacent to the terminal wall such that the pin member defines the at least one anchor portion.

18. The method as recited in claim 10, further comprising the steps of:

arranging the anchor strap to define an angle when engaged with the at least one anchor portion and the earthen structure; and forming the concrete portion such that the at least one anchor pocket defines first and second walls that are angled with respect to each other to accommodate the angle formed by the anchor strap.

19. A reinforced concrete wall panel that engages at least one anchor strap to stabilize an earthen structure, the concrete wall panel comprising:

a concrete portion;

a rebar structure at least partly within the concrete portion; and an anchoring system comprising:

at least one anchor pocket arranged within the concrete portion of the at least one reinforced concrete wall panel;

at least one anchor structure comprising at least one anchor portion, at least one primary anchor member, and at least one secondary anchor member, wherein the at least one anchor pocket defines a terminal wall, an opening lateral dimension, a terminal lateral dimension adjacent to the terminal wall, an opening vertical dimension, and a terminal vertical dimension adjacent to the terminal wall, where the opening lateral dimension is larger than the terminal lateral dimension, the terminal lateral dimension is larger than a width of the at least one anchor strap, and the opening vertical dimension is larger than the terminal vertical dimension; and each anchor portion is adapted to engage the at least one anchor strap.

20. The reinforced concrete wall panel as recited in claim 19, in which:

the anchor strap defines an angle when engaged with the at least one anchor portion and the earthen structure; and the at least one anchor pocket defines first and second walls that are angled with respect to each other to accommodate the angle formed by the anchor strap.

* * * * *